United States Patent [19]

Engel

[11] 4,048,907

[45] Sept. 20, 1977

[54] RADIAL PISTON PUMP OR MOTOR WITH UNRESTRICTED INLET MEANS

[75] Inventor: William K. Engel, Peoria, Ill.

[73] Assignee: Caterpillar Tractor Co., Peoria, Ill.

[21] Appl. No.: 638,582

[22] Filed: Dec. 8, 1975

[51] Int. Cl.[2] ..... F01B 13/06

[52] U.S. Cl. ..... 91/492

[58] Field of Search ..... 91/491–498

[56] References Cited

U.S. PATENT DOCUMENTS

| | | | |
|---|---|---|---|
| 2,290,764 | 7/1942 | Neuland | 91/507 |
| 3,090,361 | 5/1963 | Orshansky, Jr. | 91/483 |
| 3,199,460 | 8/1965 | Bush et al. | 91/497 |
| 3,657,971 | 4/1972 | Freeman | 91/487 |
| 3,805,641 | 4/1974 | Hause | 74/701 |
| 3,899,957 | 8/1975 | Carlson | 91/490 |
| 3,913,456 | 10/1975 | Bosch | 91/497 |

FOREIGN PATENT DOCUMENTS

| | | | |
|---|---|---|---|
| 1,397,918 | 6/1975 | United Kingdom | 91/498 |

*Primary Examiner*—William L. Freeh

*Attorney, Agent, or Firm*—Phillips, Moore, Weissenberger, Lempio & Majestic

[57] ABSTRACT

A radial piston pump comprises a housing having a drive shaft rotatably mounted therein and a rotor operatively connected to the shaft for rotation therewith. A pintle valve is mounted in the housing and the rotor is rotatably mounted thereon for communicating fluid from an inlet of the housing to an outlet thereof. A plurality of circumferentially spaced and radially extended pistons are mounted on the rotor with each of the pistons having a cylinder reciprocally mounted on an end thereof for pumping purposes. The inlet communicates with an inlet side of the pintle valve via a single inlet passage which communicates unrestricted fluid flow therethrough.

10 Claims, 4 Drawing Figures

RADIAL PISTON PUMP OR MOTOR WITH UNRESTRICTED INLET MEANS

BACKGROUND OF THE INVENTION

This invention relates to a radial piston pump or motor of the type comprising a pintle valve having a rotor rotatably mounted thereon and a plurality of pistons secured on the rotor and disposed circumferentially thereabout. A closed cylinder is reciprocally mounted on the end of each of the pistons for communicating pressurized fluid to an outlet of the pump upon rotation of the rotor. The rotor is eccentrically mounted relative to a cylindrical chamber defined in a housing of the pump and the cylinders are maintained in sliding bearing contact with surface portions defining the inside diameter of the chamber.

Such pumps may each comprise a plurality of separate passages for communicating an inlet to the pump with an inlet side of the pintle valve. The passages may give rise to cavitation and related problems, particularly when the pump is run at high speeds in excess of its pumping capacity.

SUMMARY OF THIS INVENTION

An object of this invention is to provide a non-complex and economical radial piston pump or motor which is capable of high speed operations and yet assures an unrestricted and adequate volume of fluid to an inlet side of a pintle valve means thereof to alleviate cavitation and related problems. The apparatus of this invention further comprises a housing having a shaft rotatably mounted therein and a pump means, including the pintle valve means, mounted in a cylindrical chamber defined in the housing for selectively pumping fluid from an inlet to an outlet thereof.

Each pump means further comprises a rotor operatively connected to the shaft for rotation therewith and rotatably mounted on the pintle valve means. A plurality of circumferentially spaced and hollow piston means are mounted on the rotor and a cylinder means is reciprocally mounted on the end of each of the piston means for pumping fluid to the outlet of the housing upon rotation of the rotor. The inlet communicates an unrestricted flow of fluid to an inlet side of the pintle valve means via a single passage means.

BRIEF DESCRIPTION OF THE DRAWINGS

Other objects of this invention will become apparent from the following description and accompanying drawings wherein.

DETAILED DESCRIPTION

Figures 1, 4:
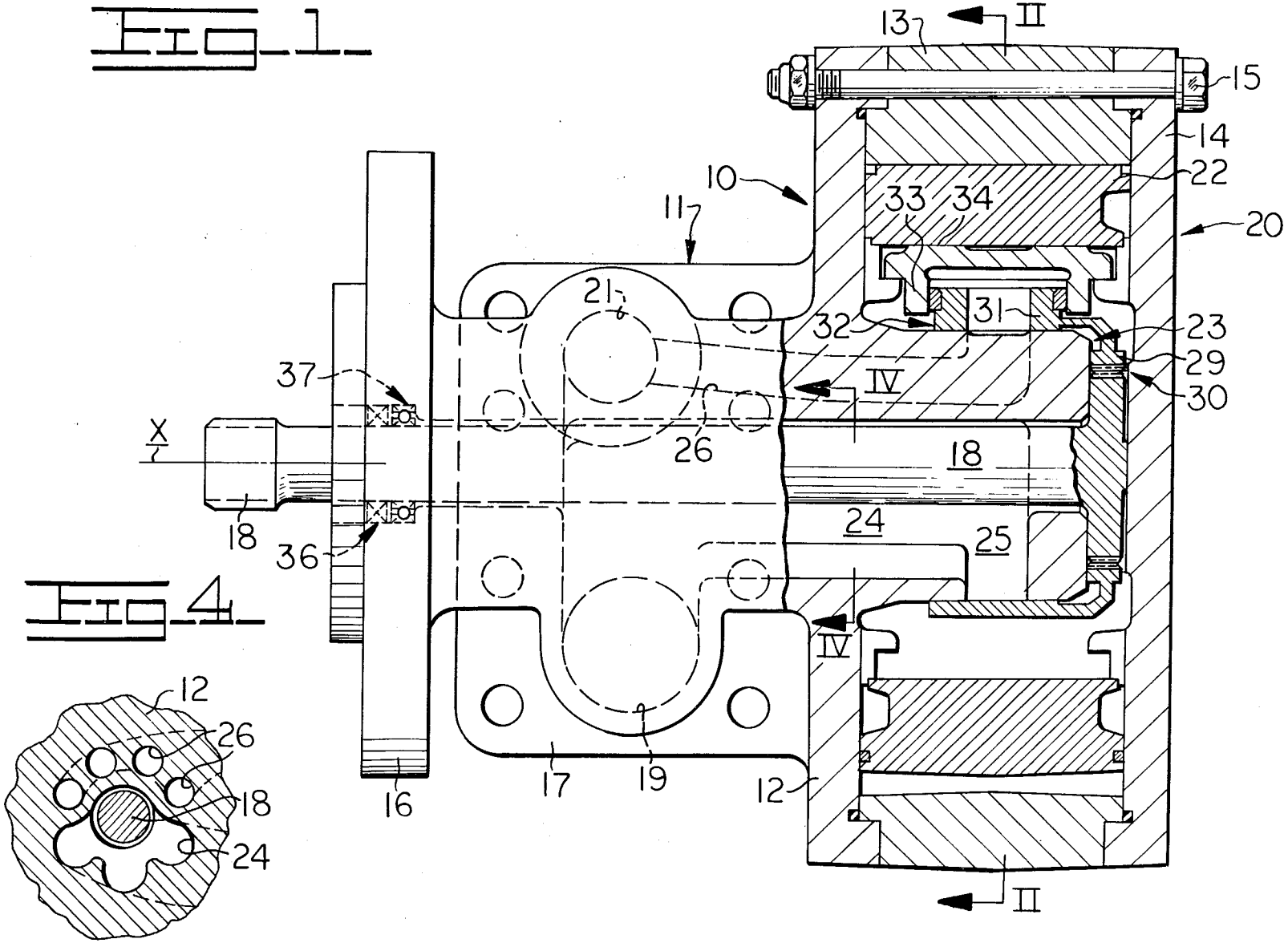
FIG. 1 is a partially sectioned side elevational view of a radial piston apparatus embodying this invention with the sectioned portion taken generally along section line I—I in FIG. 2.
FIG. 4 is a sectional view, taken in the direction of line IV—IV in FIG. 1.

FIG. 1 illustrates an apparatus 10 which may constitute a radial piston pump or motor. The apparatus comprises a housing 11 including a main body portion 12, a cylindrical spacer member 13 and an end or cover plate 14 all attached together by a plurality of circumferentially disposed bolts 15. The housing further comprises a mounting flange 16 on an end thereof and a flange 17 is shown as being disposed perpendicular to flange 16 and adapted for attachment to a pair of inlet and outlet conduits (not shown).

Figure 3:
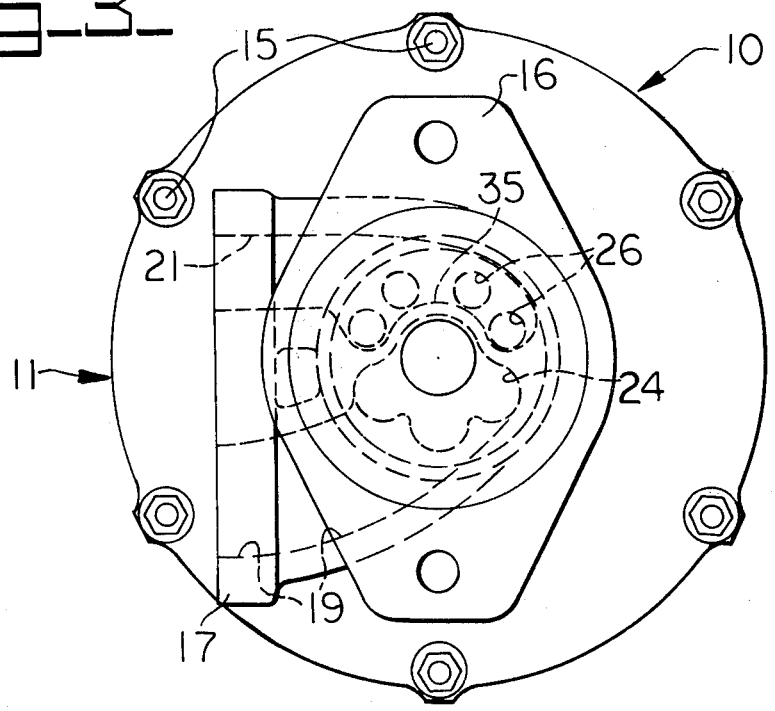
FIG. 3 is an end elevational view of the apparatus.

A shaft 18 may be rotatably mounted in the housing in bearing means for rotation about a longitudinal axis X thereof. In pump applications, a single inlet means 19 is defined in flange 17 and in main body portion 12 of the housing for communicating hydraulic fluid thereto upon its connection to an inlet conduit. A pump means 20 is adapted to pump fluid from the inlet means to an outlet means 21, which may be defined through common flange 17 (FIG. 3), or disposed in another position on the housing.

The pump means is mounted in a cylindrical chamber defined by wall portions formed internally on a cylindrical bearing member 22 which may be shiftably mounted within member 13 of the housing to selectively vary the displacement of the pump by means, not shown, such as a hydraulic actuator. A pintle valve means 23 is mounted in the housing and may form a lateral extension of main body portion 12 thereof to communicate with inlet means 19 via first passage means 24, having shaft 18 disposed therein, which terminates at a single inlet chamber 25 defined on an inlet side of the pintle valve means. The first passage means constitutes a single and substantially unrestricted passage, preferably formed in the housing to have a substantially constant cross sectional area throughout its entire length.

Figure 2:
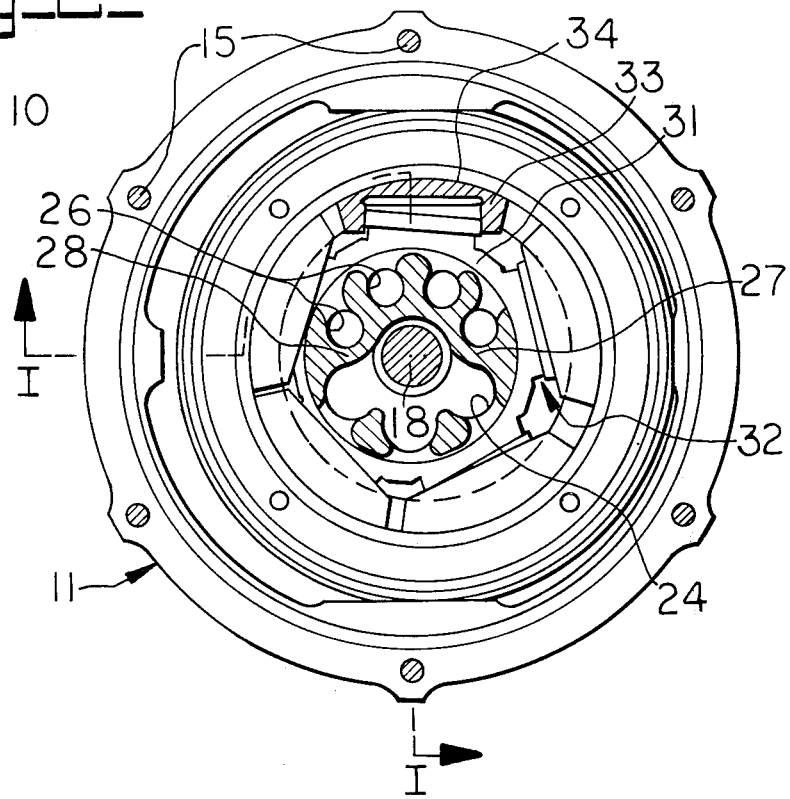
FIG. 2 is a transverse cross sectional view of the apparatus, taken in the direction of arrows II—II in FIG. 1.

Second passage means 26, constituting four separate outlet passages, are also suitably formed in main body portion 12 of the housing. The outlet passages communicate an outlet side of the pintle valve means with outlet means 21 (FIGS. 1 and 2). It should be noted in FIG. 2 that chamber 25 is isolated from the outlet passages by diametrically opposed partitions 27 and 28 of the pintle valve.

The pump means further comprises a rotor 29 which is operatively connected to a first end of shaft 18 at a spline connection 30 and is disposed interiorly of the housing. The rotor is substantially annularly shaped to comprise a cylindrical portion 31, rotatably mounted on the pintle valve means in eccentric relationship relative to the cylindrical chamber formed internally of member 22. As is well known in the art, pressurized fluid can thus be pumped from the inlet means to the outlet means upon rotation of the shaft and rotor.

The pump means further comprises a plurality of circumferentially spaced piston means 32, disposed on the rotor to extend radially outwardly therefrom. A cylinder means 33 is mounted on the end of each of the piston means for relative reciprocal movement therebetween and has an arcuate bearing face 34 on the closed outer end thereof. The bearing face engages internal wall portions defining the cylindrical chamber of member 22 in sliding bearing contact therewith. It should be noted in FIG. 1 that a standard annular seal 36 and bearing 37 may be disposed radially between the housing and shaft 18.

From the above description it can be seen that rotation of shaft 18 will rotate rotor 29 of the pump means to thus reciprocate cylinder means 33 thereof. Fluid communicated to inlet chamber 25 of the pintle valve means will thus be pumped into outlet passages 26 and thence to a manifold 35 (FIG. 3) communicating with outlet means 21. As mentioned above, it should be understood that the above-described pump could be utilized as a motor by communicating pressurized fluid from a source, not shown, and into inlet means 19 for effecting rotation of shaft 18. It would be obvious that, alternatively, the ports may be switched to effect reverse rotation.

I claim:

1. A radial piston apparatus comprising a housing, a shaft rotatably mounted in said housing for rotation about a longitudinal axis thereof, inlet means defined in said housing for communicating fluid therein, outlet means defined in said housing for communicating fluid therefrom, and pump means mounted in a cylindrical chamber defined in said housing, said pump means comprising pintle valve means mounted in said housing and defining a single inlet chamber therein, a rotor operatively connected to said shaft for rotation therewith and rotatably mounted on said pintle valve means in eccentric relationship relative to said cylindrical chamber, a plurality of circumferentially spaced and hollow piston means mounted on said rotor to extend radially outwardly therefrom, a cylinder means mounted on an end of each of said piston means for relative reciprocal movement therebetween and disposed in sliding bearing contact internally of said cylindrical chamber, first passage means, having said shaft disposed therein constituting a single and substantially unrestricted passage defined in said housing and extending from said inlet means to said single inlet chamber, and second passage means defined in said housing for communicating an outlet side of said pintle valve means with said outlet means.

2. The apparatus of claim 1 wherein said first passage means has a substantially constant cross sectional area throughout its length between said inlet means and said inlet chamber.

3. The apparatus of claim 1 wherein said second passage means constitute a plurality of separate passages defined in said housing for communicating an outlet side of said pintle valve means, isolated from said inlet chamber thereof, with said outlet means.

4. The apparatus of claim 1 wherein the rotor of said pump means is substantially annularly shaped and is operatively connected to an end of said shaft at a spline connection.

5. The apparatus of claim 1 wherein said housing comprises a main body portion having the pintle valve means of said pump means secured on an end thereof.

6. The apparatus of claim 5 wherein said housing further comprises a cylindrical spacer member mounted on said main body porton and a cylindrical bearing member shiftably mounted within said spacer member and wherein said chamber is defined by surface portions formed internally on said bearing member.

7. The apparatus of claim 6 wherein said housing further comprises a cover plate attached on an end of said spacer member.

8. The apparatus of claim 1 wherein said inlet and outlet means are each defined in a flange of said housing adapted to have inlet and outlet conduits attached thereto, respectively.

9. The apparatus of claim 8 wherein the flanges defining said inlet and outlet means constitute a common flange.

10. The apparatus of claim 8 wherein said housing further comprises a mounting flange formed integrally on the end thereof and disposed in perpendicular relationship relative to the longitudinal axis of said shaft.

* * * * *